US006867661B2

(12) United States Patent
Dawn et al.

(10) Patent No.: US 6,867,661 B2
(45) Date of Patent: Mar. 15, 2005

(54) MILLIMETER WAVE MODULE HAVING PROBE PAD STRUCTURE AND MILLIMETER WAVE SYSTEM USING PLURALITY OF MILLIMETER WAVE MODULES

(75) Inventors: Debasis Dawn, Yamanashi (JP); Yoji Ohashi, Kawasaki (JP); Toshihiro Shimura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/234,870

(22) Filed: Sep. 4, 2002

(65) Prior Publication Data

US 2003/0030506 A1 Feb. 13, 2003

Related U.S. Application Data

(63) Continuation of application No. PCT/JP00/01356, filed on Mar. 6, 2000.

(51) Int. Cl.[7] ..... H01P 5/08
(52) U.S. Cl. ..... 333/34; 333/246
(58) Field of Search ..... 333/33, 34, 246, 333/247, 260

(56) References Cited

U.S. PATENT DOCUMENTS

| | | | | |
|---|---|---|---|---|
| 4,851,794 A | * | 7/1989 | Williams et al. | 333/33 |
| 4,862,120 A | * | 8/1989 | Ruxton et al. | 333/34 |
| 4,906,953 A | * | 3/1990 | Li et al. | 333/33 |
| 6,483,406 B1 | * | 11/2002 | Sawa et al. | 333/247 |

FOREIGN PATENT DOCUMENTS

| | | |
|---|---|---|
| EP | 0 977 298 A2 | 2/2000 |
| EP | 0 977 298 A3 | 10/2001 |
| GB | 1016121 | 1/1966 |
| JP | 2-88269 | 7/1990 |
| JP | 4-357898 | 12/1992 |
| JP | 9-321501 | 12/1997 |
| JP | 10-335910 | 12/1998 |
| JP | 11-153616 | 6/1999 |
| JP | 2000-049502 | 2/2000 |

OTHER PUBLICATIONS

Dawe et al., "Characterization of Active and Passive Millimeter–Wave Monolithic Elements by On–Wafer Probing", 1989 IEEE International Microwave Symposium–Digest; pp. 413–415, Jun. 1989, XP010085610.

* cited by examiner

*Primary Examiner*—Stephen E. Jones
(74) *Attorney, Agent, or Firm*—Katten Muchin Zavis Rosenman

(57) ABSTRACT

A millimeter wave system includes a plurality of millimeter wave modules, each of which comprises a substrate; a microstrip conductor formed on one surface side of the substrate; a ground plate formed on the other surface side of the substrate; and conductive pads which are disposed on both sides of a strip conductor portion which extends from said microstrip conductor via a tapered portion, and which are connected to the ground potential of said ground plate through a via hole, wherein the strip conductors of this plurality of millimeter wave modules are connected to each other using conductive ribbon. Moreover, when a plurality of millimeter wave modules is connected to form a millimeter wave system, the effect produced by the interaction between the unnecessary conductive pads connected to the ground potential and the strip conductor can be reduced.

12 Claims, 7 Drawing Sheets

MILLIMETER WAVE MODULE HAVING PROBE PAD STRUCTURE AND MILLIMETER WAVE SYSTEM USING PLURALITY OF MILLIMETER WAVE MODULES

This application is a continuation of international application number PCT/P00/01356, filed Mar. 6, 2000.

FIELD OF THE INVENTION

The present invention relates to a millimeter wave module having a probe pad structure, and a millimeter wave system using a plurality of millimeter wave modules.

RELATED ART

It is difficult for a finished millimeter wave system to store a device, circuit elements, antennae and so forth all on a single module. Therefore, millimeter wave systems have been constructed from a plurality of millimeter wave modules, and the millimeter wave systems have been finished by connecting the interfaces of the millimeter wave module packages with conductive ribbon.

Meanwhile, measurement of the millimeter wave module characteristic must be conducted. This measurement is conducted by making a probe contact the inlet/outlet terminal of the millimeter wave module.

As the probe, a Coplanar line probe by Cascade Microtech Inc., for example, is used. In order to conduct measurement with this Coplanar line probe, a structure comprising a signal probe pad which connects to a microstrip conductor formed on the millimeter wave module and a ground probe pad which is made to contact one surface side of the potential of a ground plate is necessary.

Then, in order to ensure that the probe contacts the potential of the ground plate on the rear surface of the millimeter wave module, it is necessary to form a ground probe pad, to which the probe contacts by drawing a ground conductor via a through hole to the front surface side.

FIG. 1 is a view to explain the form and measurement method of a conventional probe pad when this Coplanar line probe is used. In FIG. 1, a microstrip conductor 2 is formed on a millimeter wave module substrate 25. When measuring the characteristic of this module, a pad unit 21 which is prepared as a separate entity to the millimeter wave module substrate 25 is used.

This pad unit 21 comprises a strip conductor 24 which is electrically connected to the microstrip conductor 2 on the millimeter wave module substrate 25 by a conductive ribbon 20, and pads 23 which are connected to the rear-surface ground conductor via through holes 22 formed on both sides of the strip conductor 24.

Measurement of the millimeter wave module 25 connected by the conductive ribbon, or in other words, bonding wire 20, is performed using this kind of pad unit 21. Then, when measurement is complete, the pad unit 21 is connected to another millimeter wave module using the conductive ribbon 20, and measurement of the characteristic of this millimeter wave module is performed.

A similar measurement process is repeated in this manner, using the pad unit 21, each time the characteristic of a millimeter wave module is measured.

Furthermore, in the construction of a millimeter wave system, when measurement using this pad unit 21 is completed for each of the plurality of millimeter wave modules which constitute the millimeter wave system, the microstrip conductors 2 formed on each of the identically constructed millimeter wave modules 25-1 and 25-2 are connected in succession by conductive ribbons 20, whereby a finished millimeter wave system is obtained.

Here, performing measurement as above, by connecting the pad unit 21 to a millimeter wave module each time measurement is to be performed is disadvantageous from the point of view of work efficiency.

SUMMARY OF THE INVENTION

Accordingly, the principal idea of the present invention relates to form conductive pads in advance on the same surface as the microstrip conductor, which are connected to the ground potential on the substrate of each millimeter wave module.

Here, when a plurality of millimeter wave modules are connected to form a complete millimeter wave system, some of the ground probe pads which are connected to the ground potential formed on the respective millimeter wave modules become unnecessary and are left over.

However, these unnecessary ground probe pads sometimes have undesirable effects on the characteristic due to their interaction with the microstrip conductor.

Thus the present invention proposes a desirable probe pad structure and arrangement, as a result of further analysis of the effect of the unnecessary ground probe pads connected to the ground potential.

The basic constitution of the millimeter wave module of the present invention for attaining this and other objects includes: a substrate; a microstrip conductor formed on one surface of this substrate; a ground plate formed on the other surface of this substrate; and conductive pads which are disposed on both sides of a strip conductor portion which extends from the microstrip conductor via a tapered portion, and which are connected to the ground potential of the ground plate through a via hole.

Further, a millimeter wave system is constructed by connecting a plurality of the aforementioned millimeter wave modules to each other, the strip conductors of each of this plurality of millimeter wave modules being connected to each other by ribbon conductors.

In a preferable mode, the conductive pads are characterized in being formed as polygons.

In another preferable mode, when the wavelength which is propagated by the microstrip conductor is $\lambda g$, the length of the part of the side of the polygonal conductive pads that is parallel to the strip conductor is $\lambda g/20$ or less, and the spacing between the side of the polygons and the strip conductor is $\lambda g/16$ or greater.

In a further preferable mode, the polygonal conductive pads are arranged such that a vertex of the polygons faces the microstrip conductor.

In a further preferable mode, the conductive pads are characterized in being circular.

Further features of the present invention will become apparent in the embodiments of the invention to be explained below with reference to the drawings.

DESCRIPTION OF EMBODIMENTS

Figure 1:
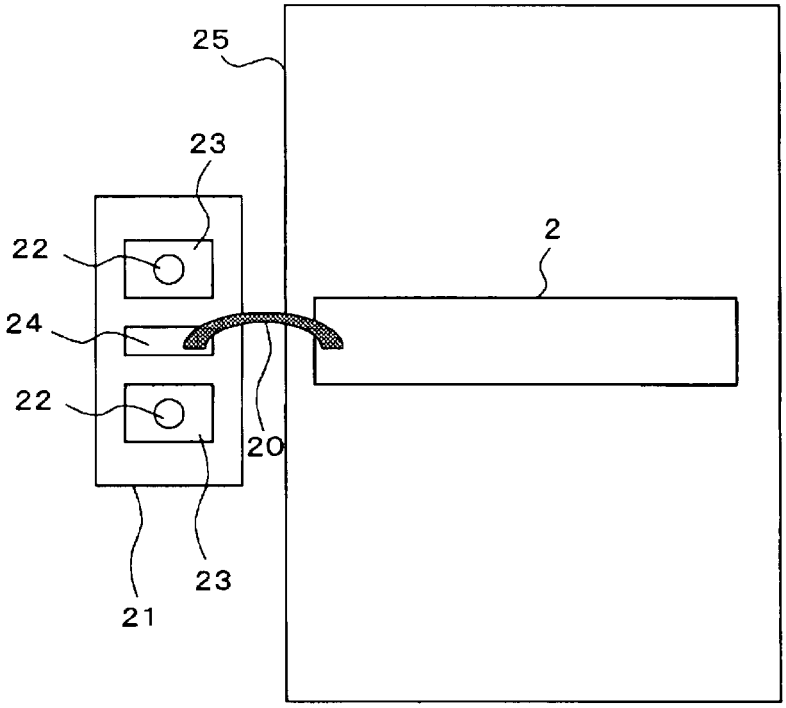
FIG. 1 PRIOR ART
FIG. 1 is a view to explain the formation and measurement method of a conventional probe pad when a Coplanar line probe is used.
Figure 2:
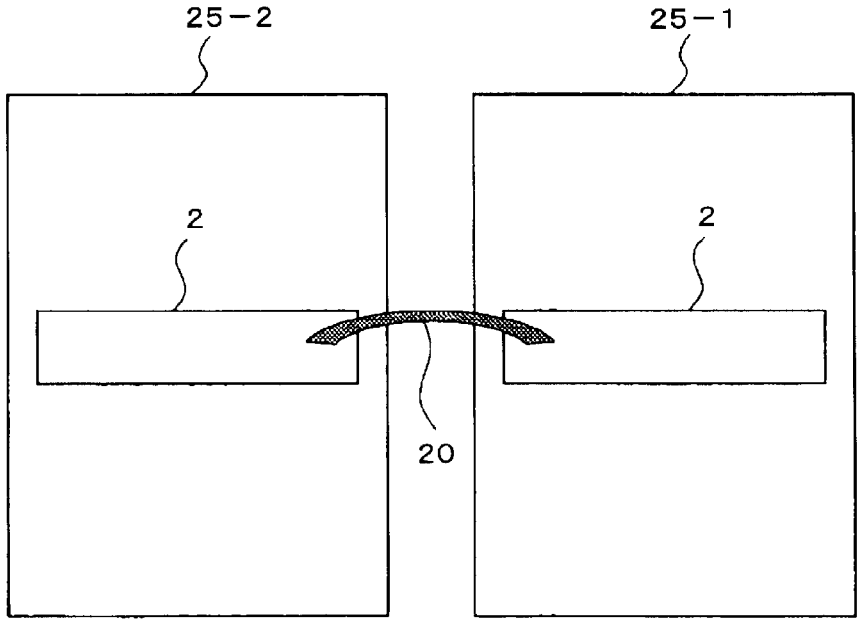
FIG. 2 PRIOR ART
FIG. 2 is a view to explain a case in which millimeter wave modules corresponding to FIG. 1 are connected to form a finished millimeter wave system.

Embodiments of the present invention will be explained below in accordance with the drawings. Note that in the drawings identical or similar elements are explained using the same reference numeral or reference symbol.

Figure 3:
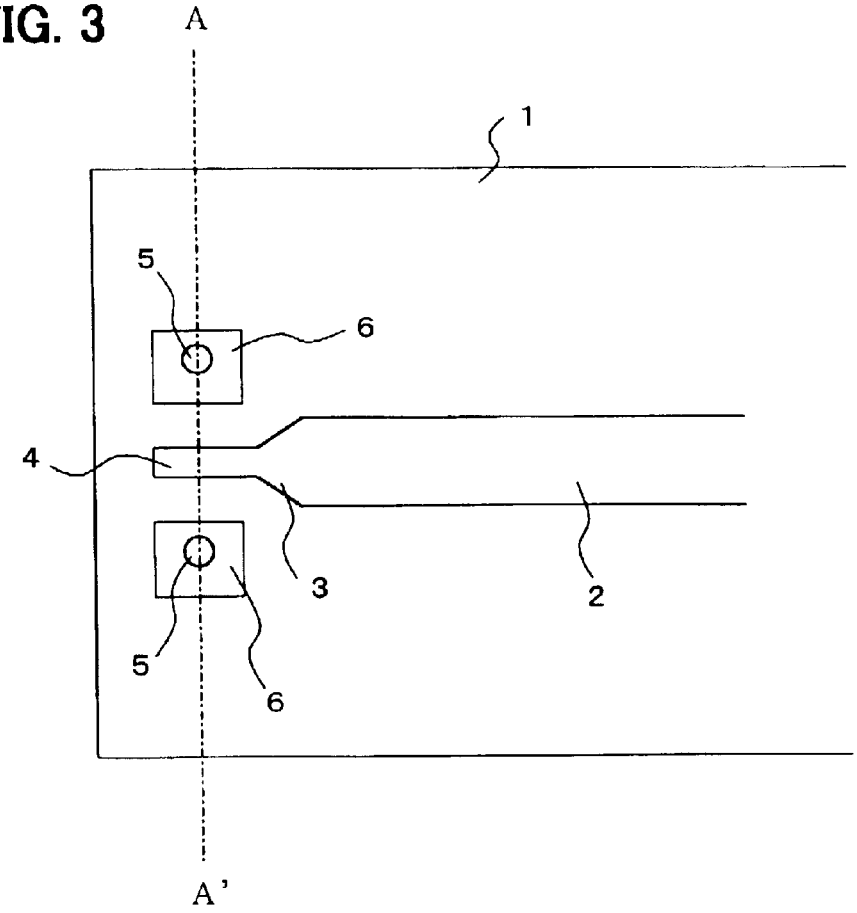
FIG. 3 is a view to explain a first embodiment of the millimeter wave module of the present invention.
Figure 4:
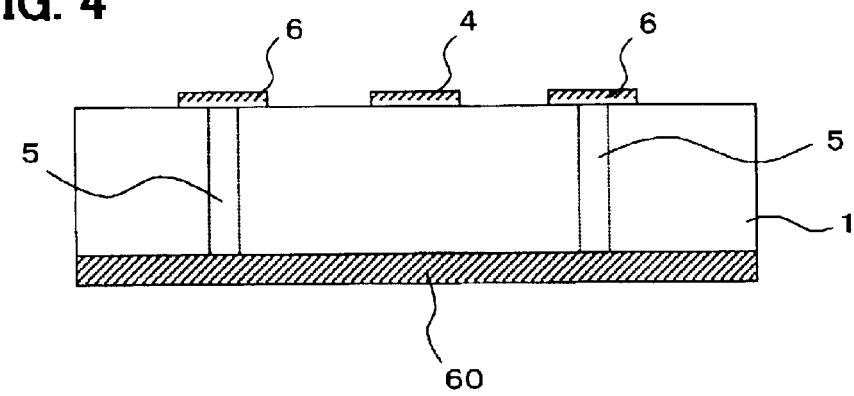
FIG. 4 is a cross section of the millimeter wave module along the A-A' line of FIG. 3.

FIG. 3 is a view to explain the first embodiment of the present invention. It shows an enlargement of the interface portion of a substrate 1 of a millimeter wave module. FIG. 4 is a cross section along the A-A' line in FIG. 3.

In FIG. 3, a microstrip conductor 2 is formed on the substrate 1 of the millimeter wave module. A tapered portion 3 is provided on the same surface on the millimeter wave module substrate 1 in the part facing toward the interface portion of the microstrip conductor 2, and a strip conductor 4 is provided ahead of the tapered part 3 to form an inlet/outlet end portion.

Conductive pads 6 are provided on both sides of the strip conductor 4, and these conductive pads 6 are electrically connected to a ground plate 60 formed on the rear surface of the substrate 1 via metal cylinders 5 at the same potential.

These conductive pads 6 are used to cause a Coplanar line probe to contact the ground potential. Further, the microstrip conductor 4 is used to cause the central conductor of the Coplanar line probe to electrically contact the microstrip conductor 2.

When the characteristic of the millimeter wave module is measured, the ground conductor of the Coplanar line probe contacts the conductive pads 6, the central conductor of the probe contacts the strip conductor 4, and measurement is thus performed.

As was explained in FIG. 1, since the present invention is formed with a probe pad structure having conductive pads 6 and a strip conductor 4 on the same surface of the substrate of the millimeter wave module 1, the need to prepare the pad unit 21 as a separate entity to the substrate 1 disappears.

Figure 5:
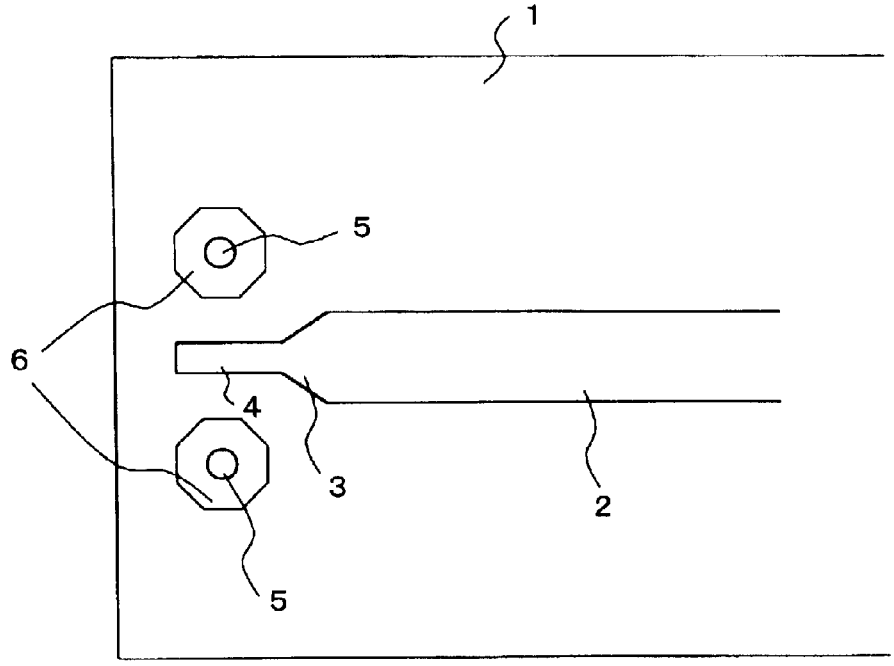
FIG. 5 is a view to explain the form and arrangement of the conductive pads of the example in FIG. 3 when these pads are formed as hexagons.

FIG. 5 is a view to explain another constitutional example of the present invention in which the form of the conductive pads 6 has been altered. In comparison with FIG. 3, the form of the conductive pads 6 has been changed from quadrilateral to hexagonal.

Figure 6:
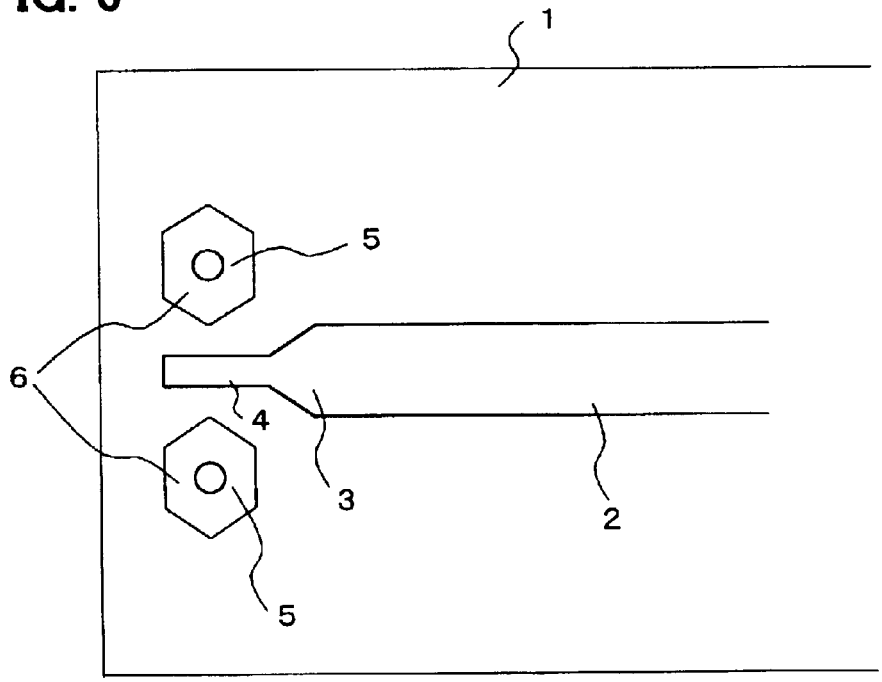
FIG. 6 is a view showing a constitutional example in which the conductive pads of FIG. 5 are arranged at a different angle.

FIG. 6 is a view to explain a further constitutional example. In comparison with FIG. 5, the angle portion of the hexagonal conductive pads is disposed so as to face the strip conductor 4. The other parts in the examples in FIGS. 5 and 6 are the same as the constitutional example in FIG. 3, and therefore further explanation is omitted.

Although not illustrated in the drawings, the conductive pads 6 may also have a circular form instead of a polygonal form.

In any of the constructions in FIGS. 3 through 6, the present invention is formed with a probe pad structure having conductive pads 6 and a strip conductor 4 on the same surface of the substrate of the millimeter wave module 1. Thereby, as was explained in FIG. 1, the need to prepare the pad unit 21 as a separate entity to the substrate 1 disappears.

Figure 7:
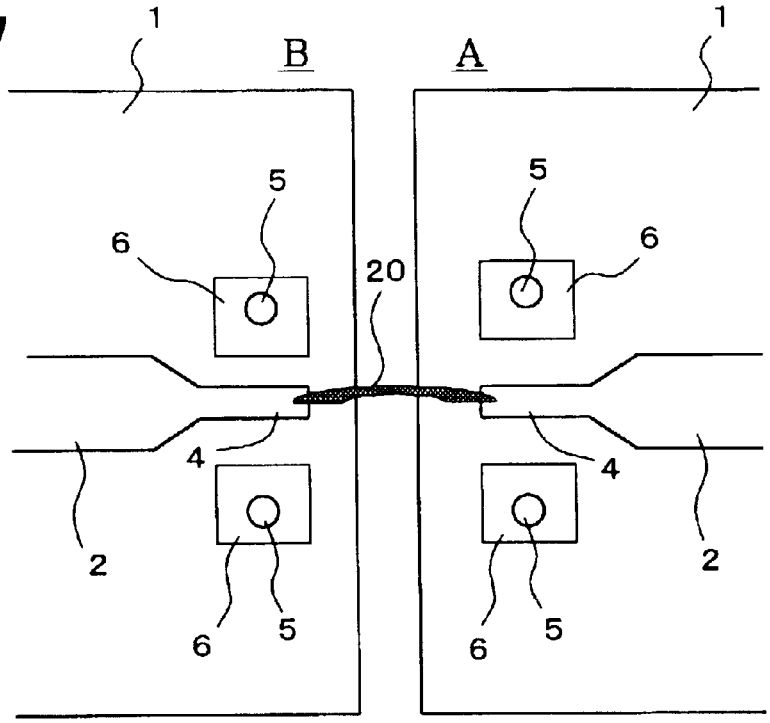
FIG. 7 is a view to explain the connection between modules having the conductive pads of FIG. 3.

FIG. 7 shows an example of a millimeter wave system which is constructed by connecting two millimeter wave modules A and B which are constituted as in the example in FIG. 3, that is having quadrilateral conductive pads 6, using a conductive ribbon, or in other words, a bonding wire 20. Note that the conductive ribbon 20 is connected to the strip conductor 4 by bonding.

The pad configuration on the interface portions of the two modules A and B are identical. When the two modules A and B are connected using a conductive ribbon 20 to form a millimeter wave system, the conductive pads 6 that are electrically connected to the ground plate 60 on the rear surface via through holes 5 so as to have the same potential become unnecessary. This is the same for the following examples.

Here, in FIG. 7, there is an area in which the edges of the conductive pads 6 and the strip conductor 4 are opposed to one another in parallel. As a result, the characteristic is undesirably affected by the interaction between the conductive pads 6 which became unnecessary when the millimeter wave system was formed and the strip conductor 4.

Accordingly, in the present invention the length of the parallel area between the edges of the conductive pads 6 and the strip conductor 4 in this case has been shortened, and the spacing between the edges of the conductive pads 6 and the strip conductor 4 has been widened, whereby, as has been verified by analysis, the effect upon the characteristic due to the interaction between these conductive pads 6 and the strip conductor 4 can be avoided.

The dimensions of these modifications are as follows: when the wavelength propagated through the microstrip conductor 2 is $\lambda g$, the length of the area in which the edges of the conductive pads 6 and the strip conductor 4 are parallel is $\lambda g/20$ or less. Further, the spacing between the edges of the conductive pads 6 and the strip conductor [4] is $\lambda g/16$ or greater.

Figure 8:
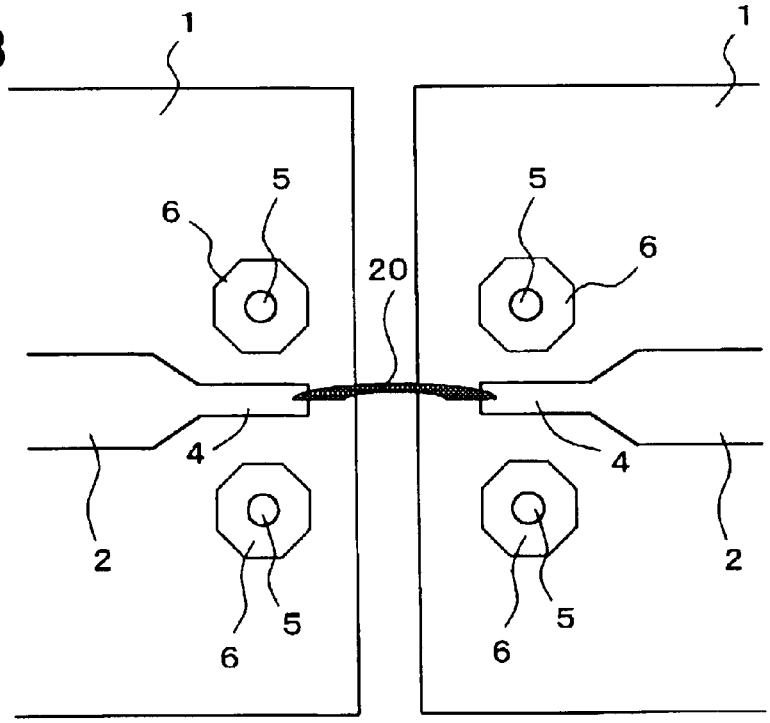
FIG. 8 is a view to explain the connection between modules having the conductive pads of FIG. 5.

FIG. 8 shows an example of a millimeter wave system which is constructed by connecting two millimeter wave modules A and B, which are constituted as in the example in FIG. 5, using a conductive ribbon 20. As in the example in FIG. 7, the pad configuration on the interface portions of each of the millimeter wave modules A and B is identical.

When the strip conductors 4 of the two millimeter wave modules A and B are connected using a conductive ribbon 20 to form a millimeter wave system, the conductive pads 6 that are electrically connected to the ground plate 60 on the rear surface via through holes 5 so as to have the same potential become unnecessary.

As for the effect produced from the interaction between the unnecessary conductive pads 6 and the strip conductor 4, the length of the area in which the edges of the conductive pads 6 and the strip conductor 4 are parallel can easily be shortened by making the form of the conductive pads 6 hexagonal. In other words, the criterion which was discovered by the present inventors, namely setting the length of the area in which the edges of the conductive pads 6 and the strip conductor 4 are parallel to λg/20 or less, can be realized even more easily.

Figure 9:
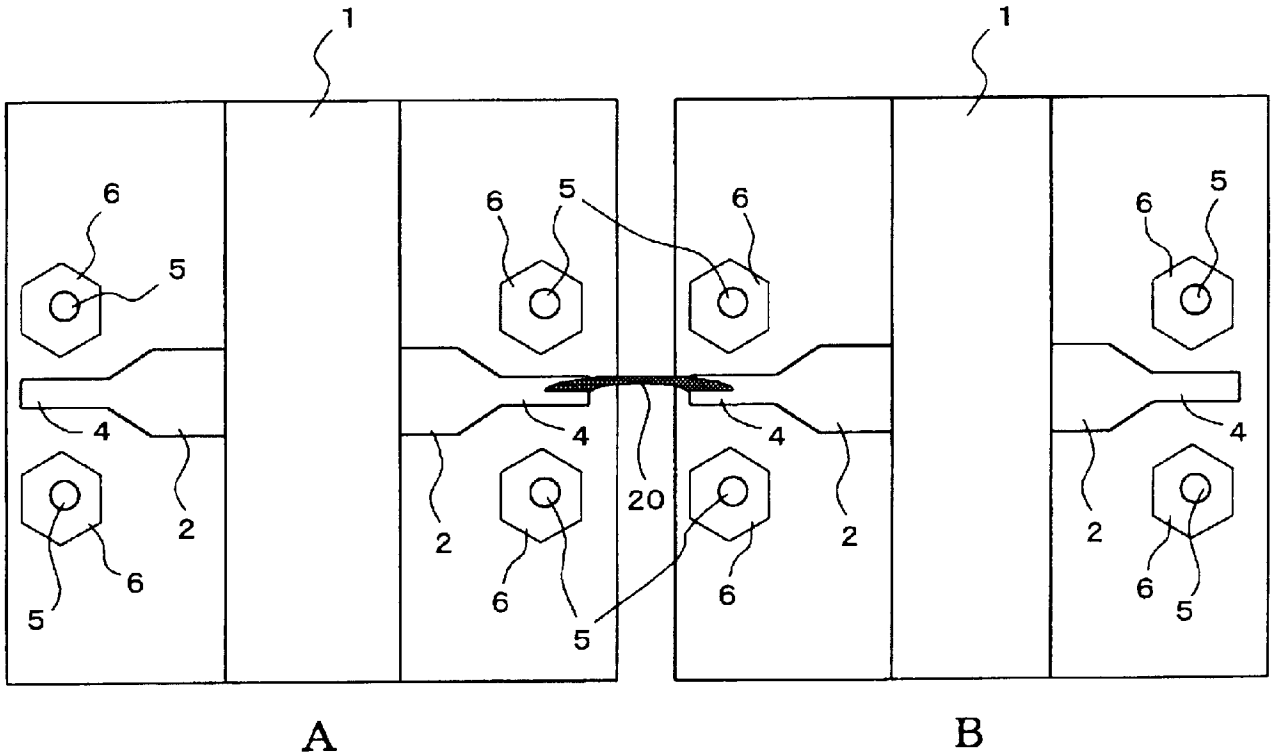
FIG. 9 is a view explaining the connection between modules having conductive pads on the inlet and outlet end sides.

FIG. 9 is a view showing a further constitutional example. The form of the conductive pads 6 on the two modules A and B is the same as that shown in FIG. 6. The respective millimeter wave modules employ the form of the conductive pads 6 and the strip conductor 4 construction of FIG. 6 at the inlet end and outlet end.

In FIG. 9, the strip conductor 4 at the outlet end of the millimeter wave module A is connected to the strip conductor 4 at the inlet end of the millimeter wave module B by a conductive ribbon 20. Thus the conductive pads 6 at the outlet end of the millimeter wave module A and the conductive pads 6 at the inlet end of the millimeter wave module B become unnecessary. Meanwhile, the conductive pads 6 at the inlet end of the millimeter wave module B and the conductive pads 6 at the outlet end of the millimeter wave module B are used in a connection with the outside.

Here, in the example in FIG. 9, the conductive pads 6 have the form of the example in FIG. 6, wherein the part facing the strip conductor 4 is an angle portion of the hexagon. In other words, the strip conductor 4 is faced with a point, and hence the condition of setting the length of the area in which the edges of the conductive pads 6 and the strip conductor 4 are parallel to λg/20 or less is satisfied as a matter of course.

In this manner, according to the constitution of the present invention, a millimeter wave system can be easily constructed by successively connecting inlet and outlet end microstrip conductors 4 using conductive ribbon 20, and in so doing connecting a plurality of millimeter wave modules to each other.

Figure 10:
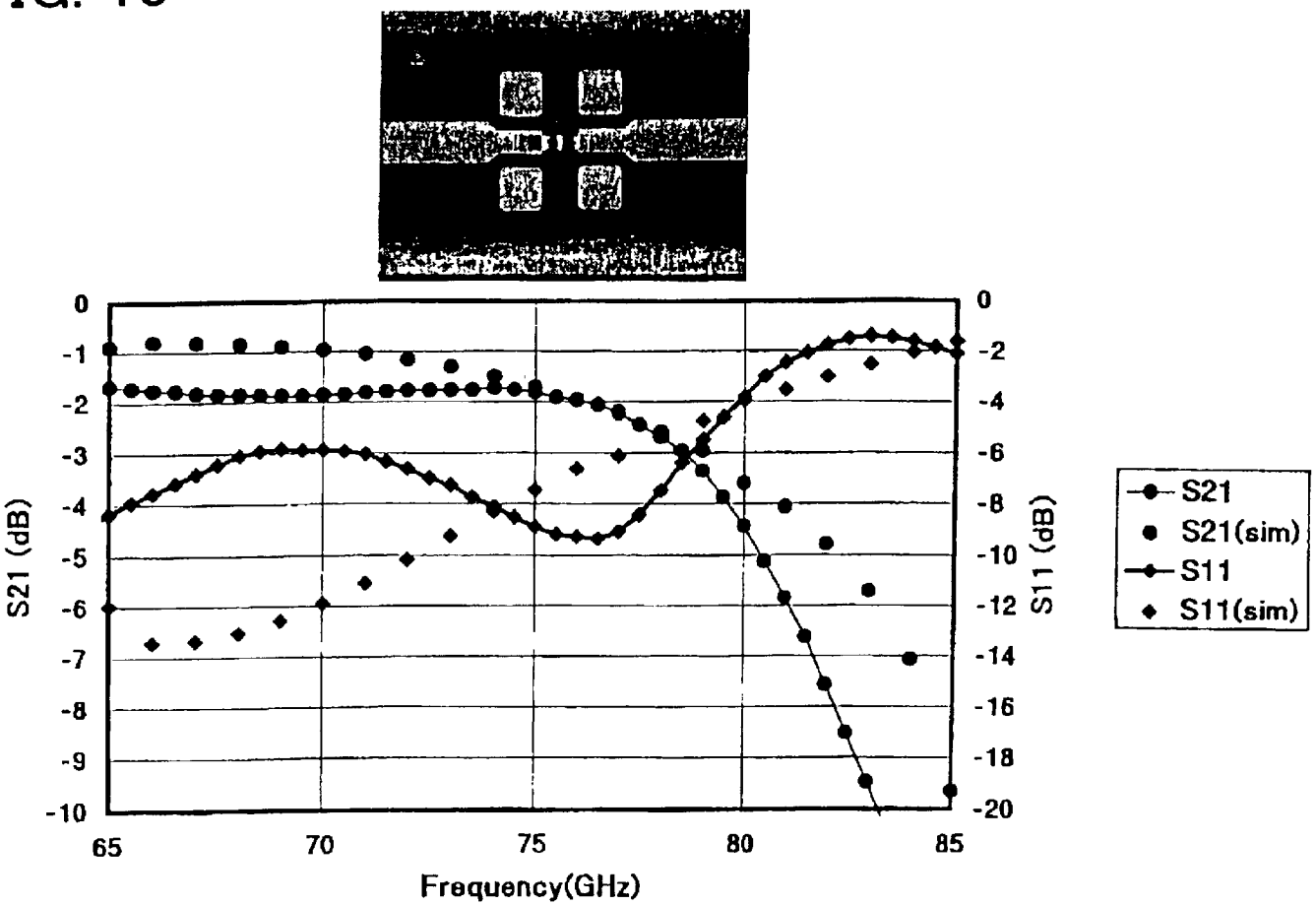
FIG. 10 shows experimental data and simulation data for a millimeter wave system using conductive pads in the form of the example in FIG. 7.
Figure 11:
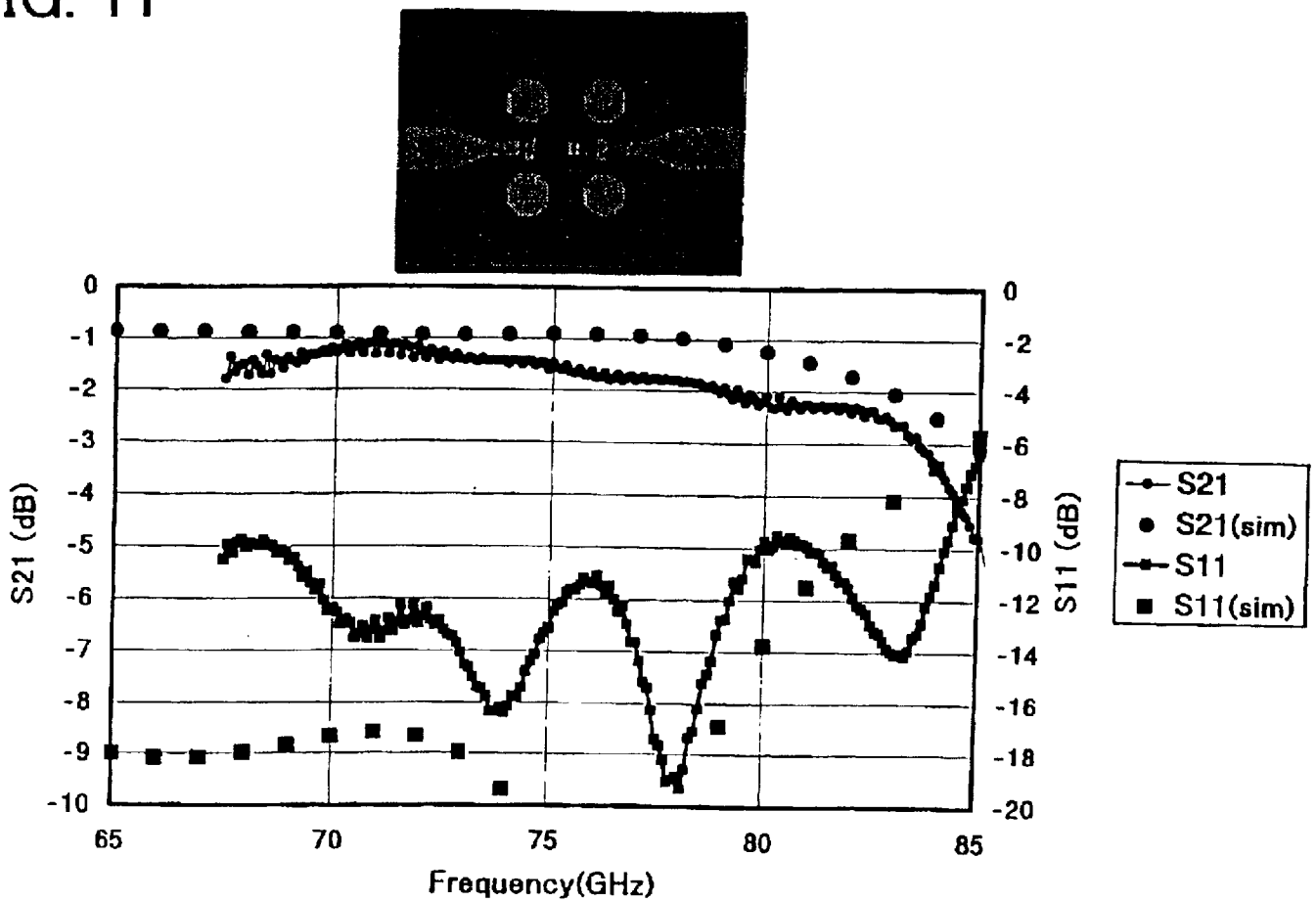
FIG. 11 shows experimental data and simulation data for a millimeter wave system using conductive pads in the form of the example in FIG. 8.

FIGS. 10 and 11 are graphs showing measurement data and simulation results of an example of the present invention. FIG. 10 shows an example corresponding to the example in FIG. 7, wherein millimeter wave modules with quadrilateral conductive pads 6 disposed on both sides of the strip conductors 4 are connected to each other using conductive ribbons.

Here, in the probe pad comprised by the conductive pads 6 and the strip conductor 4 formed on the substrate 1 of the millimeter wave module, the width of the strip conductor 4 and the spacing between the conductive pads 6, which are connected to the ground potential, and the strip conductor 4 are set such that this probe pad has general input/output impedance of 50 Ohm.

The reason for this is that the commercially available Coplanar line probe has impedance of 50 Ohm, and therefore an impedance mismatch during measurement can be averted.

It can be seen from the features of FIG. 10 that in both the experimental data and the simulation data, reflection rises rapidly at 75 GHz or above (see parameter S11), and the transmission amount becomes smaller (see parameter S21). In FIGS. 10 and 11, the parameter S11 illustrates reflection from a first port, and S21 illustrates the transmission amount of a second port from the first port.

FIG. 11 shows the data for a case in which the hexagonal conductive pads corresponding to the example in FIG. 8 are used in order to improve upon the features in FIG. 10. In other words, in FIG. 11, the form of the conductive pads 6 is hexagonal, and therefore the edges of the conductive pads 6 facing the strip conductor 4 are shorter. Moreover, the distance from the conductive pads 6 to the central strip conductor 4 is larger. As a result, input impedance wavers from 50 Ohm. However, the edges facing the strip conductor 4 are short and the distance from the central strip conductor 4 is large, and therefore the effects of mutual connecting can be reduced.

Thus, as can be seen in FIG. 11, no abnormal phenomena occur in the transmission amount until at least 80 GHz (see parameter S21). At the same time, it can be seen that the level of reflection is also suppressed to 10 dB or less until 80 GHz (see parameter S11).

INDUSTRIAL APPLICABILITY

As was described above, by providing the probe pad construction according to the present invention, characteristic measurement of a millimeter wave module using a Coplanar line probe is simplified. Moreover, when a plurality of millimeter wave modules is connected to form a millimeter wave system, the effect produced by the interaction between the unnecessary conductive pads connected to the ground potential and the strip conductor can be reduced. Thus, reflection can be reduced up to a high frequency band, and a deterioration in transmission amount can be prevented.

What is claimed is:

1. A millimeter wave module comprising:

a microstrip line including a substrate, a microstrip conductor formed on one surface side of the substrate, and a ground plate formed on the other surface side of the substrate;

a conductive portion formed on the other surface side of the substrate and adapted for receiving a probe including a strip conductor portion extending from said microstrip conductor and having a width narrower than that of the microstrip conductor, a tapered conductor portion connecting the microstrip conductor and the strip conductor portion; and a pair of conductive pads, each of which is disposed on each side of the strip conductor portion, are connected to the ground potential of said ground plate through a via hole, and are facing only a portion of the strip conductor portion, wherein at a connection between the tapered conductor portion and the strip conductor portion, an imaginary straight line that intersects the connection and is perpendicular to the strip conductor portion extends beyond the conductive pads without intersecting with the conductive pads, and wherein the strip conductor portion and the conductive pads are adapted for receiving probes.

2. The millimeter wave module according to claim 1, wherein said conductive pads are formed as polygons.

3. The millimeter wave module according to claim 2, wherein where the wavelength propagated on said microstrip conductor is λg, a side of each of the polygon conductive pads, which is parallel to the strip conductor is λg/20 or less, and the side is spaced apart from the strip conductor portion is λg/16 or greater.

4. The millimeter wave module according to claim 2, wherein said polygonal conductive pads are disposed such that the angle portions of these polygons face said strip conductor portion.

5. The millimeter wave module according to claim 1, wherein said conductive pads are circular.

6. The millimeter wave module according to claim 1, wherein said strip conductor is adapted for receiving a center conductor of a probe contact and said conductive pads are adapted to receive a ground conductor of a probe contact for measuring a characteristic of the millimeter wave module.

7. A millimeter wave system having a plurality of millimeter wave modules, each of which comprising:

a microstrip line including a substrate;

a microstrip conductor formed on one surface side of the substrate, and a ground plate formed on the other surface side of the substrate;

a conductive portion formed on the one surface side of the substrate and adapted for receiving a probe including a strip conductor portion extending from said microstrip conductor and having a width narrower than that of the microstrip conductor, and a tapered conductor portion connecting the microstrip conductor and the strip conductor portion; and a pair of conductive pads, each of which is disposed on each side of the strip conductor portion, are connected to the ground potential of said ground plate through a via hole, and are facing only a portion of the strip conductor portion, wherein at a connection between the tapered conductor portion and the strip conductor portion, an imaginary straight line that intersects the connection and is perpendicular to the strip conductor portion extends beyond the conductive pads without intersecting with the conductive pads, wherein the strip conductor portion and the conductive pads are adapted for receiving probes, and wherein the strip conductor portions of the plurality of millimeter wave modules are connected to each other by a conductive ribbon.

8. The millimeter wave system according to claim 7, wherein said conductive pads are formed as polygons.

9. The millimeter wave module according to claim 8, wherein said polygon conductive pads are disposed such that the vertexes of these polygons face said microstrip conductor.

10. The millimeter wave system according to claim 8, wherein where the wavelength propagated on said microstrip conductor is $\lambda g$, a side of each of the polygon conductive pads, which is parallel to the strip conductor is $\lambda g/20$ or less, and the side is spaced apart from the strip conductor portion is $\lambda g/16$ or greater.

11. The millimeter wave system according to claim 7, wherein said conductive pads are circular.

12. The millimeter wave module according to claim 7, wherein said strip conductor is adapted for receiving a center conductor of a probe contact and said conductive pads are adapted to receive a ground conductor of a probe contact for measuring a characteristic of the millimeter wave module.

* * * * *